US009901180B2

(12) United States Patent
Klaseen

(10) Patent No.: US 9,901,180 B2
(45) Date of Patent: Feb. 27, 2018

(54) CONVERTIBLE CHAIR

(71) Applicant: Ronald Klaseen, Crawford, CO (US)

(72) Inventor: Ronald Klaseen, Crawford, CO (US)

( * ) Notice: Subject to any disclaimer, the term of this patent is extended or adjusted under 35 U.S.C. 154(b) by 78 days.

(21) Appl. No.: 14/626,528

(22) Filed: Feb. 19, 2015

(65) Prior Publication Data

US 2015/0230609 A1 Aug. 20, 2015

Related U.S. Application Data

(60) Provisional application No. 61/942,151, filed on Feb. 20, 2014.

(51) Int. Cl.
*A47C 7/50* (2006.01)
*A47C 1/14* (2006.01)
*A47C 13/00* (2006.01)

(52) U.S. Cl.
CPC ..... *A47C 7/506* (2013.01); *A47C 1/143* (2013.01); *A47C 13/00* (2013.01)

(58) Field of Classification Search
CPC ..... A47C 1/143; A47C 13/00; A47C 7/506
USPC ..... 297/31, 111, 118, 248, 445.1, 219.1, 297/284.3, 284.2, 284.1
See application file for complete search history.

(56) References Cited

U.S. PATENT DOCUMENTS 325,326 A * 9/1885 Ditmars ..... A47C 17/207 297/110
327,605 A * 10/1885 Shaw ..... A47C 17/1655 5/18.1
1,741,192 A 12/1929 Kusterer
3,385,631 A * 5/1968 Gertler ..... A47C 17/22 297/111
4,392,598 A * 7/1983 Dixon ..... A45F 4/02 224/155
4,402,096 A 9/1983 Atimichuk
4,538,308 A 9/1985 Grigoriev
5,282,669 A * 2/1994 Barile ..... A47C 3/04 297/248
5,964,500 A * 10/1999 Lin ..... A47C 4/20 297/16.1
6,588,837 B1 7/2003 Schultz et al.
8,225,438 B2 7/2012 Murphy

FOREIGN PATENT DOCUMENTS

GB 705898 A * 3/1954 ..... A47C 9/105

* cited by examiner

*Primary Examiner* — Jose V Chen
(74) *Attorney, Agent, or Firm* — Global Intellectual Property Agency, LLC; Jordan Sworen

(57) ABSTRACT

A convertible chair is provided. The present convertible chair includes three or more sections connected together in series. The sections include a chair section, one or more middle sections, and an end section. The middle sections are slidably connected to the chair section, allowing the middle sections to slide in and out from the chair section. The end section is hingedly connected to the terminal middle section. When in the extended configuration, the sections provide a contiguous comfortable support surface on which a user can lay down. When in the compact configuration, the present invention resembles and functions as a conventional chair suitable for sitting on. The convertible chair further include connectors disposed along its sides that allow multiple chairs to be connected together in series.

17 Claims, 6 Drawing Sheets

CONVERTIBLE CHAIR

CROSS REFERENCE TO RELATED APPLICATION

This application claims the benefit of U.S. Provisional Application No. 61/942,151 filed on Feb. 20, 2014. The above identified patent application is herein incorporated by reference in its entirety to provide continuity of disclosure.

FIELD OF THE INVENTION

The present invention relates to convertible chairs. More specifically, the present invention relates to chairs that are adapted to transition between a conventional chair configuration and an extended configuration.

BACKGROUND OF THE INVENTION

Chairs in airports, waiting rooms, and other such locations where people are expected to potentially wait for extended periods of time are very uncomfortable to relax in while waiting. Sitting in an uncomfortable chair for an extended period of time can be uncomfortable and potentially painful. Furthermore, the waiting individuals may wish to lay down when waiting, but there may not be a feasible option for doing so. Therefore, there is a need for a device that is adapted to be comfortable to sit or lay on for extended periods of time.

SUMMARY OF THE INVENTION

In view of the foregoing disadvantages inherent in the known types of convertible chairs now present in the prior art, the present invention provides a convertible chair wherein the same can be utilized for providing convenience for the user when seeking to lay down when waiting for an extended period of time. The present convertible chair comprises three or more sections connected together in series. The sections comprise a chair section, one or more middle sections, and an end section. The middle sections are slidably connected to the chair section, allowing the middle sections to slide in and out from the chair section. The end section is hingedly connected to the terminal middle section. When in the extended configuration, the sections provide a contiguous comfortable support surface on which a user can lay down. When in the compact configuration, the present invention resembles and functions as a conventional chair suitable for sitting on.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
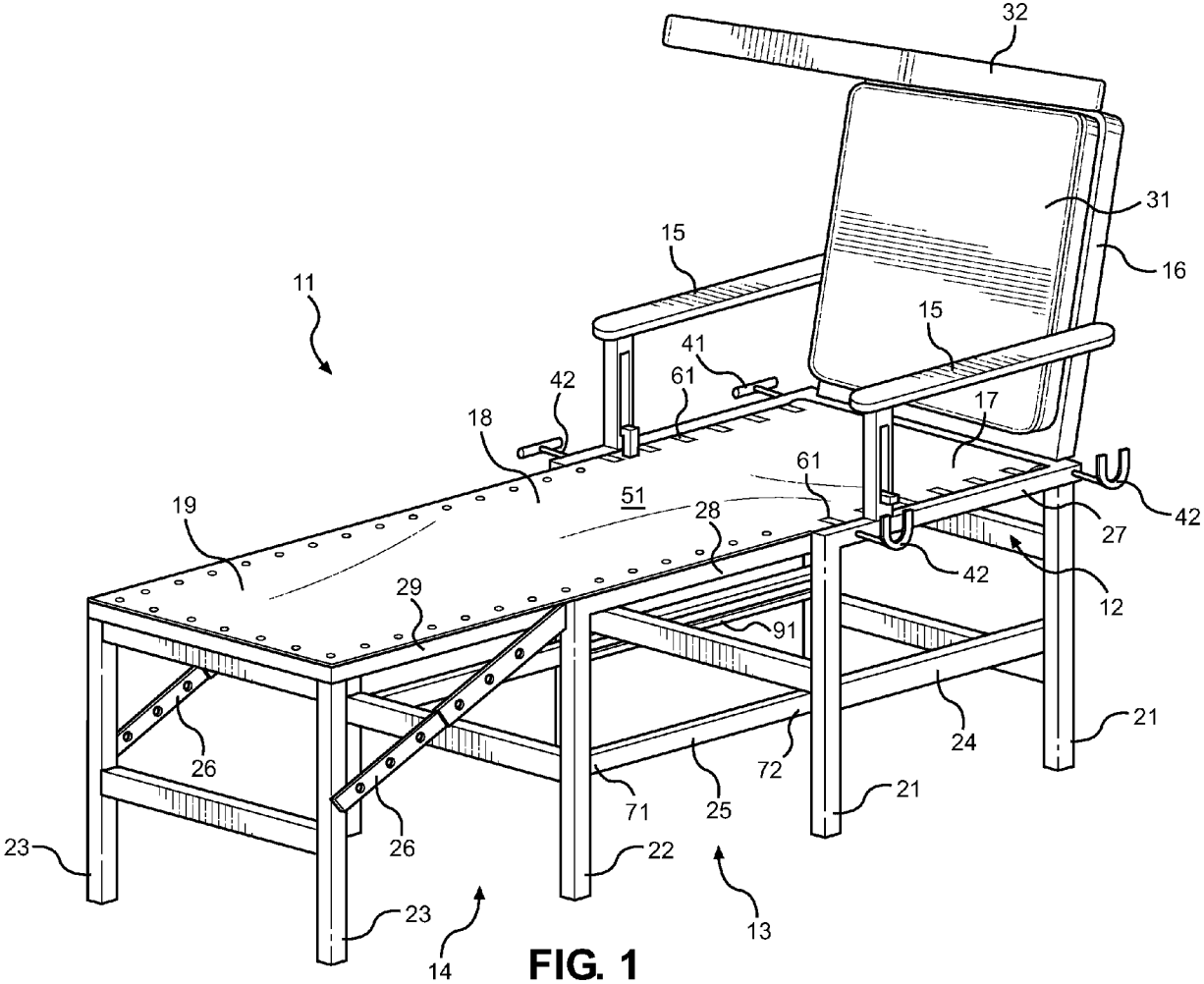
FIG. 1 shows a perspective view of the present invention in its extended configuration.

Reference is made herein to the attached drawings. Like reference numerals are used throughout the drawings to depict like or similar elements of the convertible chair. For the purposes of presenting a brief and clear description of the present invention, the preferred embodiment will be discussed as used for transitioning the present invention between an extended configuration suitable for sitting or laying thereon and a compact configuration suitable for sitting thereon. The figures are intended for representative purposes only and should not be considered to be limiting in any respect.

Referring now to FIG. 1, there is shown a perspective view of the present invention in its extended configuration. The present invention is a convertible chair 11 that is adapted to transition between an extended configuration suitable for sitting or laying on, as shown in FIG. 1, and a compact configuration suitable for sitting on. The present convertible chair 11 comprises a chair section 12, a middle section 13 slidably connected to the chair section 12, and an end section 14 hingedly connected to the middle section 13. In the extended configuration, the chair section 12, middle section 13, and end section 14 create a contiguous, substantially planar support surface 51 suitable for sitting or laying thereon. The convertible chair 11 is transitioned to its compact configuration by folding the end section 14 onto the middle section 13, then sliding the middle section 13 into the chair section 12, which reduces the length of the support surface 51 suitable for a user to sit upon.

The chair section 12 of the present invention further comprises a frame 27, one or more back legs 21 extending from the lower portion of the frame 27, a seat portion 17 of the support surface 51 held taut between the interior edges of the frame 27, one or more armrests 15 extending from the upper portion of the frame 27, and a back 16 extending from the upper portion of the frame 27. In the depicted embodiment of the present invention, the back legs 21 are arranged in pairs; however, the present disclosure contemplates any type of arrangement for the back legs 21. The chair section 12 further comprises one or more back lateral supports 24 extending between opposing pairs of the back legs 21.

The middle section 13 comprises a frame 28, one or more middle legs 22 extending from the bottom surface of the frame 28, and a middle portion 18 of the support surface 51 held taut between the interior edges of the frame 28. The middle section 13 is slidably connected to the chair section 12, such that the legs 22 of the middle section 13 can slide between the back legs 21, thereby allowing the middle section to slide into the chair section 12. In the depicted embodiment of the present invention, the middle section 13 is slidably connected to the chair section 12 via one or more middle lateral supports 25 having a first end 71 connected to one of the middle legs 22 and a second end 72 slidably connected to the back lateral supports 24 of the chair section 12. In the depicted embodiment of the present invention, the slidable connection between the middle lateral supports 25 and the back lateral supports 24 comprises a rail 91 disposed on the back lateral supports 24 to which the middle lateral supports 25 are slidably connected. In other embodiments of the present invention, the slidable connection between the second end 72 of the middle lateral supports 25 and the back lateral supports 24 comprises one or more ball bearings, wheels, or other such slidable connection mechanisms known in the prior art.

In the embodiment of the present invention depicted in FIG. 1, the convertible chair 11 comprises a single middle section 13. However, alternative embodiments of the present invention can comprise a plurality of middle sections 13 connected together in series. For these alternative embodiments, a first middle section is slidably connected to the chair section 12, as disclosed above, and the end section 14 is hingedly connected to a terminal middle section. Additional middle sections disposed between the first middle section and the terminal middle section are slidably connected together in the same manner as disclosed above for the slidable connection to the chair section 12 or in a different manner.

The end section 14 is hingedly connected to the middle section 13, or the terminal middle section for embodiments comprising one or more middle sections 13, thereby allowing the end section 14 to transition between an extended position in which the end support 19 is with the middle support 18 in a planar manner, forming a continuous support surface 51 therewith, and a collapsed a position in which the end support 19 rests flush against the middle support 18.

The end section 14 comprises a frame 29, one or more end legs 23 extending from the undersurface thereof, and an end section 19 of the support surface 51 held taut between the interior edges of the frame 29. The end legs 23 are hingedly connected to the end section frame 29, such that the end legs 23 can transition between an extended position in which they are orthogonal to the end section frame 29 and a collapsed position in which they rest flush against the bottom surface of the end portion 19 of the support surface 51. An alternative embodiment of the present invention further comprises one or more support brackets 26 connecting the end legs 23 to the end section frame 29 to provide support for the front legs 23 when they are in their extended position. In this embodiment of the present invention, the support brackets 26 are telescoping so that they do not interfere with the movement of the end section 14 when it is collapsed. The telescoping mechanism comprises any telescoping mechanism known in the prior art. In a further alternative embodiment of the present invention, the support brackets 26 comprises a slidable locking mechanism for securing the support brackets 26 in place and preventing them from collapsing when the present convertible chair 11 is in use.

The support surface 51 of the convertible chair 11, which is made up of the seat, middle, and end portions 17, 18, 19, comprises any flexible material that can be compressed or folded without causing permanent deformation to the material, thereby allowing the middle section 13 and the end section 14 to collapse without interference from the support surface 51. In the depicted embodiment of the present invention, the support surface 51 comprises a canvas material that is stretched taut between the frames 27, 28, 29 of the sections 12, 13, 14. In the depicted embodiment of the present invention, the seat portion 17 of the support surface 51 is slidably connected to the chair section frame 27 and is fixedly connected to the middle section and end section frames 28, 29. The slidable connection between the seat portion 17 and the chair section frame 27 allows the seat portion 17 of the support surface 51 to fold as the middle section 13 is slid into the chair section 12 as the present invention is being transitioned to its compact configuration. When the convertible chair 11 is transitioned to its extended configuration from its compact configuration, the slidable connection allows the seat portion 17 of the support surface 51 to be unfolded and pulled taut. The canvas material is thus adapted to support the weight of an individual sitting or laying thereon, while still being able to be compressed or folded as needed.

Figure 2:
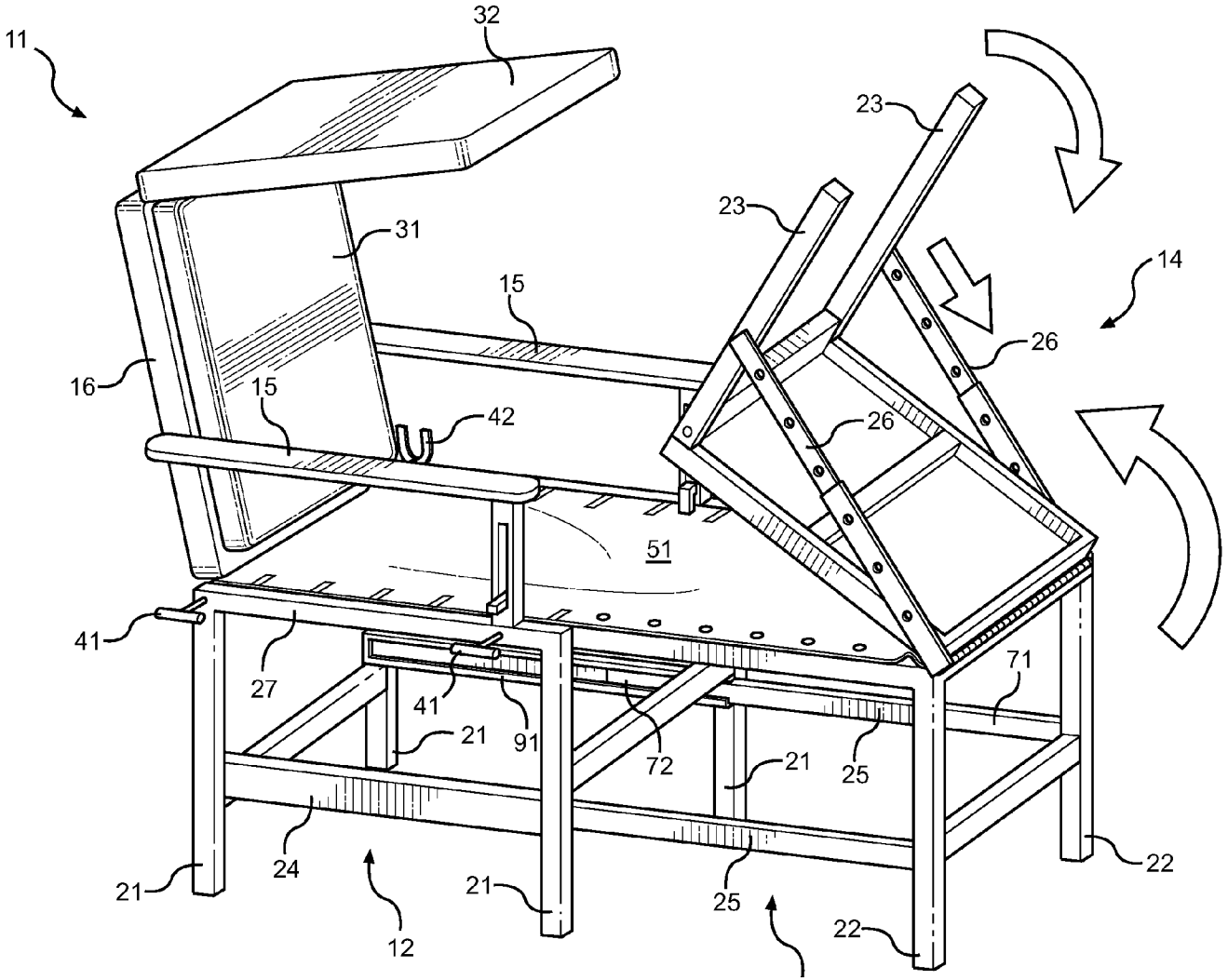
FIG. 2 shows a perspective view of the first stage of converting the present invention to its compact configuration.
Figure 3:
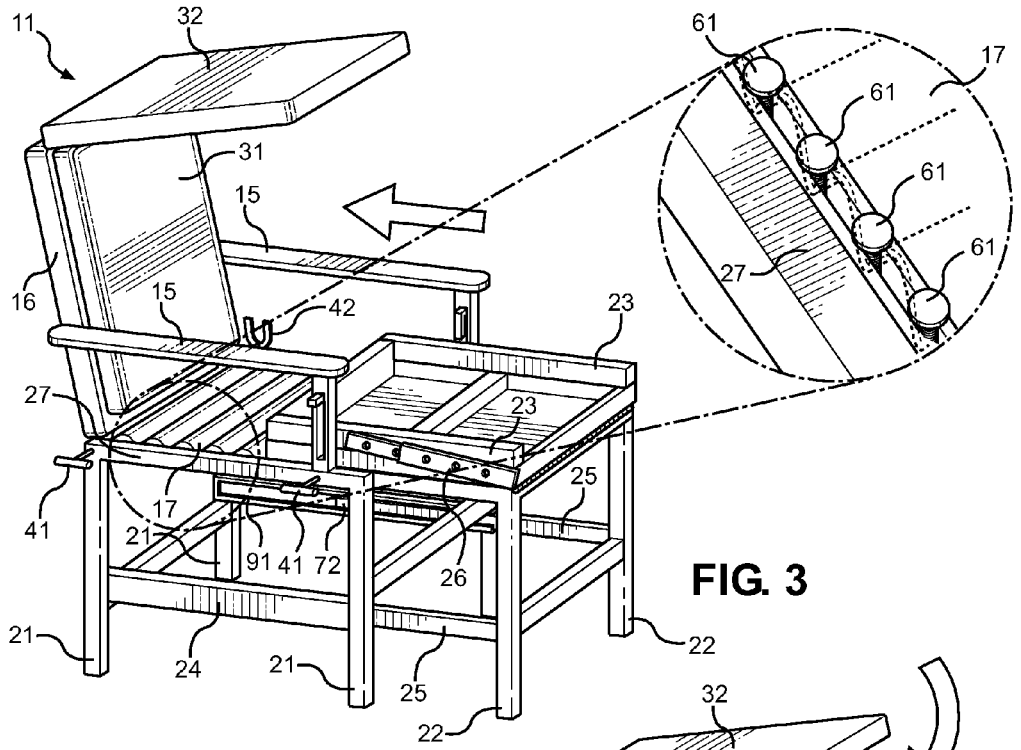
FIG. 3 shows a perspective view of the second stage of converting the present invention to its compact configuration, with a detail view showing the slidable connection between chair section portion of the support surface and the chair section frame.
Figure 4:
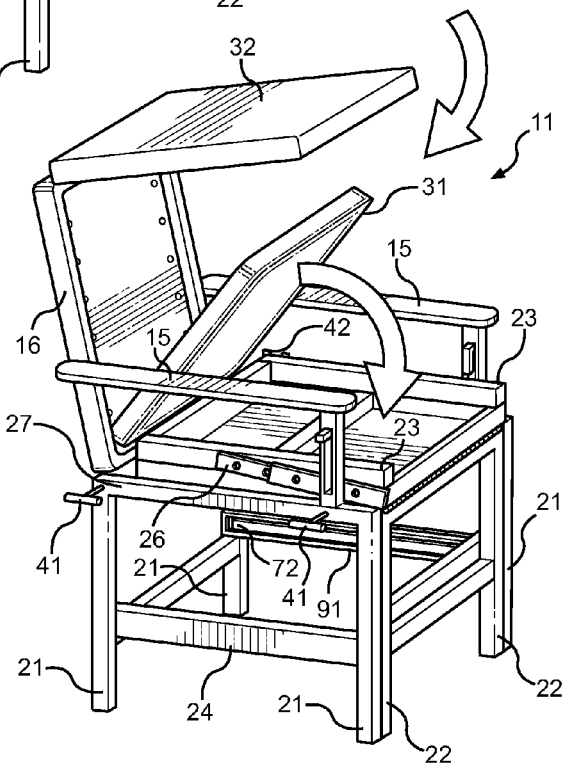
FIG. 4 shows a perspective view of the third stage of converting the present invention to its compact configuration.

Referring now to FIGS. 2-4, there are shown perspective views of the present invention being transitioned from the extended configuration to the collapsed configuration. The first step for converting the present convertible chair 11 from the extended configuration to the collapsed configuration is to fold the end section 14 upwardly so that the end section frame 29 rests flush against the upper surface of the middle section frame 28. The end legs 23 are also folded downwardly so that they rest against the bottom surface of the end section frame 29. When collapsed, the end section 14 rests compactly against the middle section 13.

The next step is to slide the one or more middle sections 13 into the chair section 12, collapsing the convertible chair 11 into a compact configuration resembling a conventional chair. In the depicted embodiment of the present invention, the slidable connection between the seat portion 17 of the support surface 51 and the chair section frame 27 comprises connectors 61 that are slidably disposed on a rail along the interior edge of the chair section frame 27, which allows for the seat 17 portion of the support surface 51 to compress as the one or more middle sections 13 are slid inwardly, into the chair section 12. In an alternative embodiment of the present invention, seat portion 17 of the support surface 51 is constructed of a compressible material.

When the middle section 13 and the end section 14 are fully collapsed, the cushions 31, 32 can then be folded downwardly to complete the conversion. The first cushion 31 is hingedly connected to the chair section frame 27 or the back 16 of the char section 12. When the convertible chair 11 is in the extended configuration, the first cushion 31 is preferably placed a raised position against the back 16. When the convertible chair 11 is in the collapsed configuration, the first cushion 31 is preferably placed in a lowered position, covering the chair section frame 27 and the end section 14 thereover. The hinged connection comprises a fabric hinged connection, a floating hinge connection, or another such connection that allows the first cushion 31 to be placed over the collapsed components of the end section 14 that are stacked over the chair section frame 27.

The second cushion 32 is hingedly connected to the top edge of the back 16 of the chair section 12. When the convertible chair 11 is in its extended position, the second cushion 32 is preferably raised so that it extends orthogonally from the back 16. The second cushion 32 holds this position by resting against the top edge of the raised first cushion 31, as shown in FIG. 1. When the second cushion 32 is in its raised position, extending from the back 16, it serves as a sunshade for a user laying on the convertible chair 11. When the convertible chair 11 is in its collapsed position and the first cushion 31 is lowered to cover the seat 17, the second cushion is preferably lowered so that it covers the back 16.

Figure 5:
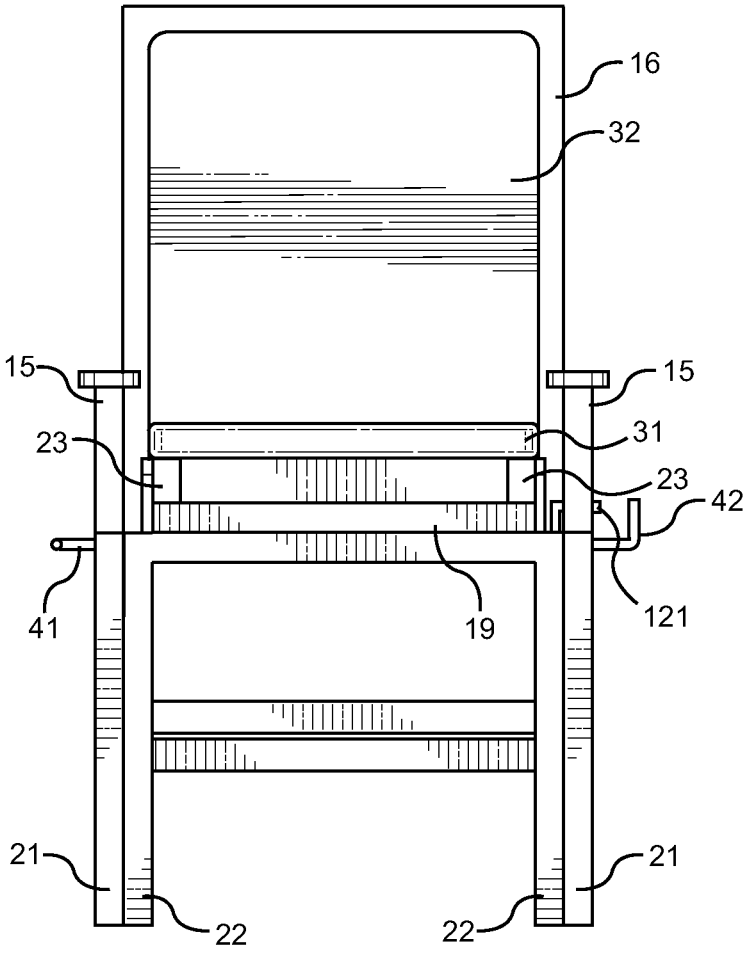
FIG. 5 shows an end elevational view of the present invention in the compact configuration.

Referring now to FIG. 5, there is shown an end elevational view of the present invention in the compact configuration. The middle section 13 is adapted to slide between the back legs 21, beneath the chair section 12, when the convertible chair 11 is collapsed into its compact configuration. As such, the outer width of the middle legs 22 is less than or equal to the inner width of the back legs 21, thereby allowing the middle legs 22 to slide between the back legs 21 without interference.

Figure 6:
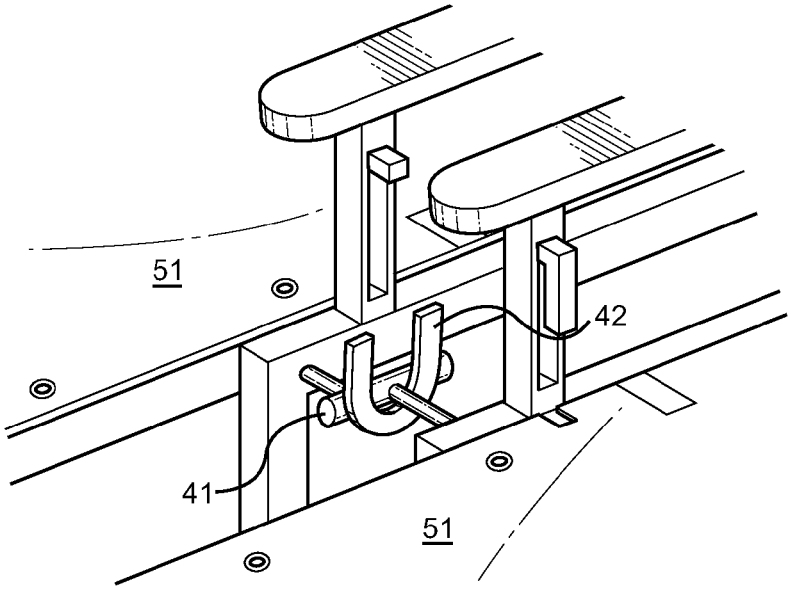
FIG. 6 shows a partial view of the connectors of the present invention.

Referring now to FIG. 6, there is shown a close up view of the connectors of the present invention. An alternative embodiment of the present invention further comprises one or more first connectors 41 and one or more second connectors 42 extending from the convertible chair 11 that are adapted to engage together, thereby allowing adjacent convertible chairs 11 to be connected together in series. In the depicted embodiment of the present invention, the first and second connectors 41, 42 extend from opposing sides of the convertible chair; however, no claim is made as to the precise number, orientation, or arrangement of the first and second connectors 41, 42.

The first and second connectors 41, 42 are removably connectable and are adapted to securely hold adjacent convertible chairs 11 securely together. In the depicted embodiment of the present invention, the first connectors 41 comprises a T-shaped member and the second connectors 42 comprise a U-shaped member adapted to receive the T-shaped member first connectors 41. Alternative embodiments of the first and second connectors 41, 42 comprise clips, magnets, hooks, and any other removable connection mechanisms known in the prior art.

Figure 7:
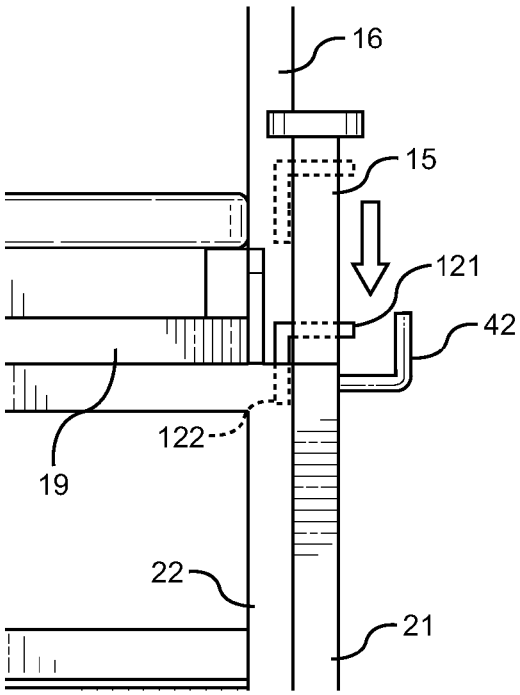
FIG. 7 shows a partial view of the locking mechanism of the present invention.

Referring now to FIG. 7, there is shown a partial view of the locking mechanism of the present invention. The present invention further comprises a locking mechanism that is adapted to lock the middle section from being pulled out of the chair section, securing the convertible chair 11 in its compact configuration and preventing it from being transitioned to its extended configuration. In the depicted embodiment, the locking mechanism comprises a locking member 121 that is slidably attached to at least one of the armrests 15. The distal end of the locking member 121 is adapted to engage with a complimentary slot 122 disposed on the middle section frame 28. The locking member 121 is engaged with the slot 122, the middle section and the chair section are secured together, which prevents the middle section from being withdrawn from the chair section. In alternative embodiments of the present invention, the locking mechanism comprises a coin-operated locking mechanism or a key-operated locking mechanism.

Figure 8A:
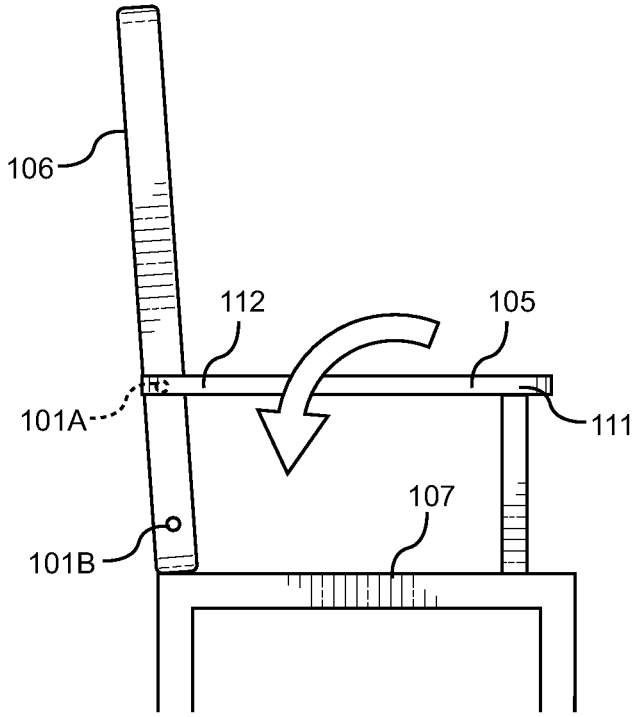
FIG. 8A shows a profile view of the present invention with the back in a first position.
Figure 8B:
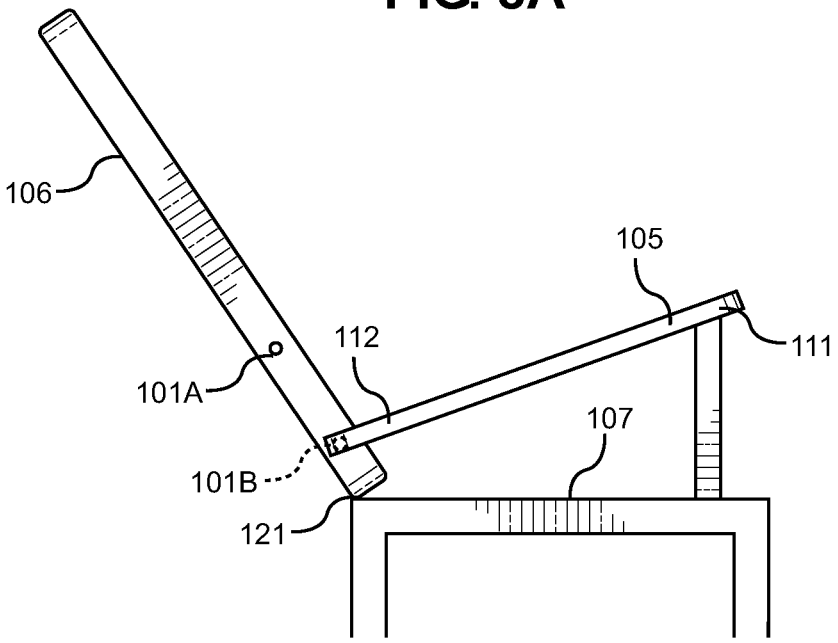
FIG. 8B shows a profile view of the present invention with the back in a second position.

Referring now to FIGS. 8A and 8B, there are shown profile views of the present invention with the back in a first position and a second position. In an alternative embodiment of the present invention, the back 106 of the convertible chair is hingedly connected 121 to the chair section 107 of the convertible chair. In this embodiment, the armrests 105 comprise a horizontal portion having a first end 111 hingedly connected to the vertical portion of the armrests 105 and a second end 112 adjustably connected to the back 106 of the convertible chair. In the depicted embodiment of the present invention, the second end 112 is adjustably connected to the back 106 of the convertible chair. In this way, the angle of the back 106 can be adjusted between a plurality of different positions to accommodate users' preferences. In an exemplary embodiment of the present invention, the second end 112 comprises a projection and the attachment points 101A, 101B comprise slots adapted to accept the projection therein. In other embodiments of the present invention, the second end 112 comprises a magnet and the attachment points 101A, 101B comprises complementary magnets engageable with the second end 112, or other such removable attachment mechanisms known in the prior art.

In an alternative embodiment of the present invention, the connector comprises a horizontal bar member that extends between and connects the second ends 112 of the armrests 105. In this embodiment, the attachment points 101A, 101B comprises notches or slots disposed on the rear surface of the back 106 with which the horizontal bar member can removably engage. Because the second ends 112 of the armrests 105 are connected together, this allows the armrests 105 to be adjusted simultaneously.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A convertible chair, comprising:

a chair section comprising a seat, a back, and one or more back legs;

a middle section comprising one or more middle legs, the middle section slidably attached to the chair section;

an end section comprising one or more end legs hingedly attached thereto, the end section hingedly attached to the middle section;

a continuous support surface;

a rail disposed along an interior edge of the chair section;

a plurality of connectors connected to the continuous support surface;

wherein each of the plurality of connectors are disposed within the rail in sliding engagement therewith;

wherein the convertible chair is adapted to transition between an extended configuration and a compact configuration.

2. The convertible chair of claim 1, further comprising:

a first cushion hingedly attached to the seat;

a second cushion hingedly attached to the back of the chair section;

wherein the second cushion is adapted to maintain a position perpendicular to the back of the chair section such that a free end of the second cushion extends toward the end section.

3. The convertible chair of claim 2, wherein the first cushion is adapted to cover the end section when the convertible chair is in the compact configuration.

4. The convertible chair of claim 1, wherein a width of each pair of the one or more middle legs is less than a width between each pair of the one or more back legs.

5. The convertible chair of claim 1, further comprising:

one or more first connectors extending from a first side of the convertible chair;

one or more second connectors extending from a second side of the convertible chair;

wherein the one or more first connectors are adapted to engage the one or more second connectors.

6. The convertible chair of claim 5, wherein the first side and the second side are on opposing sides of the convertible chair.

7. The convertible chair of claim 5, wherein the convertible chair is adapted to be connected in series.

8. The convertible chair of claim 5, wherein the first connectors comprise T-shaped members and the second connectors comprise U-shaped members.

9. The convertible chair of claim 1, further comprising one or more support brackets connecting the one or more end legs to the end section.

10. The convertible chair of claim 9, wherein the one or more support brackets are telescoping.

11. The convertible chair of claim 1, further comprising:

a back lateral support extending between the one or more back legs;

a middle lateral support extending between the one or more middle legs;

wherein the middle lateral support is slidably connected to the back lateral support.

12. The convertible chair of claim 11, further comprising:

one or more rollers disposed on the middle lateral support;

one or more tracks disposed on the back lateral support;

wherein the one or more rollers are slidably disposed along the one or more tracks.

13. The convertible chair of claim 1, further comprising a locking mechanism adapted to prevent the middle section from being withdrawn from the chair section.

14. The convertible chair of claim 13, wherein the locking mechanism comprises:

a locking member slidably disposed on an armrest disposed on the convertible chair;

a slot disposed on at the middle section;

wherein the locking member is adapted to engage with the slot when the convertible chair is in the compact configuration.

15. The convertible chair of claim 1, wherein the back is hingedly connected to the chair section.

16. The convertible chair of claim 15, further comprising:

an armrest that is adapted to be removably secured to an attachment point disposed on the back.

17. The convertible chair of claim 1, further comprising:

a brace extending between the one or more end legs.

* * * * *